US011389857B2

(12) United States Patent
Del Fabro

(10) Patent No.: US 11,389,857 B2
(45) Date of Patent: Jul. 19, 2022

(54) APPARATUS AND METHOD TO MAKE A WIRE MESH

(71) Applicant: M.E.P. Macchine Elettroniche Piegatrici S.P.A., Reana del Rojale (IT)

(72) Inventor: Giorgio Del Fabro, Udine (IT)

(73) Assignee: M.E.P. MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 188 days.

(21) Appl. No.: 16/619,549

(22) PCT Filed: Jun. 5, 2018

(86) PCT No.: PCT/IT2018/050101
§ 371 (c)(1),
(2) Date: Dec. 5, 2019

(87) PCT Pub. No.: WO2018/225108
PCT Pub. Date: Dec. 13, 2018

(65) Prior Publication Data

US 2020/0122222 A1 Apr. 23, 2020

(30) Foreign Application Priority Data

Jun. 6, 2017 (IT) ..... 102017000061837

(51) Int. Cl.
*B21F 27/10* (2006.01)
*B21F 27/20* (2006.01)

(52) U.S. Cl.
CPC ..... *B21F 27/20* (2013.01)

(58) Field of Classification Search
CPC ..... B21F 15/06; B21F 15/08; B21F 23/00; B21F 23/005; B21F 27/08; B21F 27/10; B21F 27/12; B21F 27/20; B21F 27/005
See application file for complete search history.

(56) References Cited

U.S. PATENT DOCUMENTS 5,020,575 A * 6/1991 Grabuschnig ..... B21F 23/005 140/112
2012/0103460 A1* 5/2012 Anagnostopoulos ... B21F 27/20 140/112

FOREIGN PATENT DOCUMENTS

| | | | | |
|---|---|---|---|---|
| DE | 2142321 A1 | 3/1973 | | |
| DE | 4423737 A1 | 1/1995 | | |
| DE | 9412405 U1 * | 8/1995 | ..... | B21F 27/08 |
| DE | 29714110 U1 | 10/1997 | | |
| EP | 0371956 A2 | 6/1990 | | |
| EP | 0733416 A1 * | 9/1996 | ..... | B21F 27/10 |
| EP | 1700650 A1 | 9/2006 | | |
| EP | 2149410 A1 * | 2/2010 | ..... | B21F 27/10 |

(Continued)

OTHER PUBLICATIONS

Translation; EP 21449410 A1, Nussbaumer et al. Feb. 2010.*
Int'l Search Report and Written Opinion dated Sep. 4, 2018 in Int'l Application No. PCT/IT2018/050101.

*Primary Examiner* — Edward T Tolan
(74) *Attorney, Agent, or Firm* — Panitch Schwarze Belisario & Nadel LLP

(57) ABSTRACT

An apparatus to make a wire mesh with longitudinal wires and transverse wires, on each occasion having a reciprocal pitch defined according to requirements is provided, and includes a first feeder, a second feeder and a welding unit functionally coordinated to make the desired wire mesh.

15 Claims, 3 Drawing Sheets

(56) References Cited

FOREIGN PATENT DOCUMENTS

| | | | |
|---|---|---|---|
| WO | 2007110400 | A1 | 10/2007 |
| WO | 2011010256 | A1 | 1/2011 |

* cited by examiner

APPARATUS AND METHOD TO MAKE A WIRE MESH

CROSS-REFERENCE TO RELATED APPLICATIONS

This application is a Section 371 of International Application No. PCT/IT2018/050101, filed Jun. 5, 2018, which was published in the English language on Dec. 13, 2018, under International Publication No. WO 2018/225108 A1, which claims priority under 35 U.S.C. § 119(b) to Italian Application No. 102017000061837, filed Jun. 6, 2017, the disclosures of each of which is incorporated herein by reference in their entireties.

FIELD OF THE INVENTION

Embodiments of the present invention concern an apparatus to make a wire mesh usable, for example, as, or in association with reinforcements for reinforced concrete structures, or a containing and/or separation mesh.

The present invention allows to obtain wire meshes having links of desired sizes, homogeneous or differentiated. Furthermore, the present invention also concerns a method to make a wire mesh.

The present invention is applicable to wire meshes whose components are all or partly welded together.

Embodiments of the present invention also concern a unit for positioning longitudinal wires to make the wire mesh, as well as a unit to remove and supply the longitudinal wires to a coupling and possible welding unit.

BACKGROUND OF THE INVENTION

Apparatuses are known for making wire meshes defined by a plurality of longitudinal wires located distanced from each other and by a plurality of transverse wires distanced from each other and welded to the longitudinal wires transversely to the development of the latter.

Known apparatuses usually comprise a first unit to feed the longitudinal wires, configured to supply, substantially simultaneously in the connection zone between longitudinal wires and transverse wires, a plurality of longitudinal wires distanced from each other.

Known apparatuses comprise a unit to feed the transverse wires to supply, on each occasion, and in the desired position, a transverse wire to the plurality of longitudinal wires.

These apparatuses comprise, where welding is provided, at least one welding unit to weld, on each occasion, the transverse wire to one or more longitudinal wires in the zones of reciprocal overlap.

In the state of the art, the reciprocal distance between the longitudinal wires is determined, on each occasion, by the reciprocal positioning of the individual feed units of the feeding group of the longitudinal wires, which positioning is defined in an initial setting step of the apparatus.

However, this known solution has numerous disadvantages, especially if it is necessary to make, with a single apparatus, wire meshes having links defined by wires having different sections and/or sizes, or even meshes whose longitudinal and/or transverse pitch is differentiated on each occasion by reason of specific production batches.

An apparatus is also known from DE-A-44.23.737 for making meshes comprising a first unit to feed longitudinal wires, a second unit to feed, on each occasion, at least one transverse wire, and a welding unit provided to weld each transverse wire to the longitudinal wires.

This apparatus, described in DE-A-44.23.737, also comprises a positioning unit configured to receive one longitudinal wire from the first feed unit at a time.

The longitudinal wires are located parallel to a first direction and are released toward the positioning unit, by the first feed unit, so as to distance them from each other according to a predetermined pattern. Specifically, the positioning unit comprises a positioning device provided to move the longitudinal wires in a direction orthogonal to their oblong development, that is, in a direction orthogonal to the first direction. Therefore, in the positioning unit a loading plane, or loading zone, is provided, in which the longitudinal wires are disposed approximately at the desired distance dictated by the particular configuration of the wire mesh to be obtained. Directly in the loading zone a plurality of gripping members are disposed, each of which is provided to remove one of the longitudinal wires and transfer it in a direction parallel to the longitudinal development of the longitudinal wires and toward the welding unit in which they are welded with the transverse wires.

The welding unit is directly aligned with the loading plane, or loading zone of the longitudinal wires, in a direction parallel to the longitudinal development of the latter.

The gripping members, moving in the direction parallel to the longitudinal development of the longitudinal wires, supply the latter at entrance to the welding unit which then, by successive steps, causes the longitudinal wires to advance, in order to weld the transverse wires on the latter.

Given the great length that the longitudinal wires can have, usually from a minimum of 5 m to even 12-15 m or more, the loading plane, or loading zone, remains occupied by the longitudinal wires for a good part of the welding operations as well, that is, the operations to transport the longitudinal wires toward the welding unit.

This implies rather long downtimes as regards the feeding of the longitudinal wires, with consequent losses in productivity and efficiency of the plant. The feed of the longitudinal wires toward the loading plane, in fact, usually requires significant working times, since all the longitudinal wires defining a wire mesh must be provided to the loading plane and reciprocally distanced at least in an approximate way.

During the transfer steps of the longitudinal wires toward the welding unit, and at least until the longitudinal wires have been introduced into the welding unit, it is not possible to start the positioning of a new group of longitudinal wires in the loading plane, since the latter is occupied by the previous group of longitudinal wires formed.

There is therefore a need to perfect and make available an apparatus and a method to make a wire mesh which overcome at least one of the disadvantages of the state of the art.

One purpose of the present invention is to provide an apparatus to make wire meshes which allows to reduce the working times of wire meshes by avoiding downtimes.

The present invention also sets out to provide an apparatus to make wire meshes which is extremely versatile and does not limit the production of wire meshes having pitches of sizes limited to a few ranges.

Another purpose is to provide an apparatus that occupies limited spaces or, in any case, less than the bulk of known apparatuses.

Another purpose of the present invention is to provide an apparatus able to produce wire meshes whose distances, at least between the longitudinal wires, have equal values, different values, or mixed values.

The invention can also be applied to apparatuses suitable to obtain wire meshes with longitudinal and transverse wires located orthogonal or with a desired angle.

The present invention is particularly suitable to obtain meshes in which the longitudinal wires are at predetermined distances and can be defined on each occasion in relation to the purposes of the mesh.

It is also a purpose of the present invention to provide an efficient apparatus which allows to reduce, and even to cancel, the setting times and stop times of the apparatus, even when there is a change in format of the wire mesh.

The present invention also sets out to provide a method for making wire meshes rapidly and with a pitch between the metal wires that is defined on each occasion.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern an apparatus to make a wire mesh with longitudinal wires and transverse wires connected to each other and defining links of the desired size and/or disposition.

In the present invention, by connection between longitudinal wires and transverse ones, we mainly mean by welding, but the invention is applicable to any type of connection. Hereafter in the description by the term welding we therefore mean any type of connection.

The apparatus to make a wire mesh comprises a welding unit, a first feeder configured to feed longitudinal wires, and a second feeder configured to feed, on each occasion, at least one transverse wire into the welding unit.

In accordance with one aspect of the present invention, the apparatus comprises a positioning unit configured to receive from the first feeder a plurality of longitudinal wires disposed parallel to a first direction and distanced according to a pre-set pattern.

The positioning unit comprises at least one positioning device configured to move the longitudinal wires keeping them parallel and distanced from each other in a direction of movement orthogonal to the first direction.

The apparatus comprises a plurality of gripping members each configured to remove one of the longitudinal wires from the positioning unit and to transfer them in respective directions of feed and toward the welding unit.

The directions of feed are located reciprocally distanced from each other according to a pattern coordinated with that which the longitudinal wires will assume when welded to the transverse wires.

In accordance with one aspect of the present invention, the positioning unit comprises a preparation zone and a delivery zone adjacent to each other in a direction parallel to the direction of movement.

The gripping members are located in the delivery zone in order to remove the longitudinal wires that are found in that zone.

The preparation zone has a width, in a direction parallel to the direction of movement, at least equal to or greater than the width of the delivery zone.

In this way, while in the preparation zone the first feeder delivers a first group of longitudinal wires, disposing the latter already distanced by a predefined distance, in the delivery zone a second group of longitudinal wires already previously positioned and received from the preparation zone, can be fed to the welding unit. This avoids having to stop the preparation of the longitudinal wires while waiting for the loading plane to be free.

Thanks to the present invention it is possible to make wire meshes with longitudinal wires and transverse wires welded and reciprocally distanced according to a pattern defined according to the batches to be produced.

The present invention also allows to rapidly and correctly position the longitudinal wires in relation to the distance that they will assume when the transverse wires are welded.

This considerably reduces the production times of the wire meshes and does not require long times for the format change of the wire mesh to be made.

Embodiments of the present invention also concern a method to make a wire mesh that provides to feed longitudinal wires with a first feeder and to feed with a second feeder, on each occasion, at least one transverse wire to the welding unit.

According to the present invention the method provides to:

- receive from the first feeder a plurality of longitudinal wires which are disposed in a positioning unit parallel to a first direction and distanced according to a pre-set pattern,
- move the longitudinal wires with a positioning device, keeping them parallel and distanced from each other in a direction of movement orthogonal to the first direction,
- remove each of the longitudinal wires from the positioning unit with a respective gripping member, and
- transfer the longitudinal wires with the gripping members in respective directions of feed and toward the welding unit, said directions of feed being located reciprocally distanced from each other according to a pattern coordinated to that which the longitudinal wires will assume when welded to the transverse wires.

The method in accordance with the present invention also provides that the positioning unit comprises a preparation zone and a delivery zone adjacent to each other in a direction parallel to the direction of movement, and in that whereas in the preparation zone the first feeder delivers a first group of longitudinal wires, distanced from each other according to a pre-set pattern, in the delivery zone the gripping members remove a second group of longitudinal wires previously prepared in the preparation zone.

In accordance with a possible implementation of the method, it can be provided to position a plurality of welding heads of the welding unit each aligned with a respective direction of feed and based on the interaxis between the longitudinal wires of the wire mesh to be made.

In accordance with another possible implementation of the method, it is provided to position each of the gripping members aligned with a respective direction of feed.

In accordance with another possible implementation of the method, it is provided to supply, to the positioning unit with said first feeder, the longitudinal wires reciprocally distanced according to a pattern similar to that of the subsequent removal, to perform a first removal of some of the longitudinal wires with the respective gripping members, to translate in the direction of movement the longitudinal wires remaining on the positioning unit so as to perform at least a second removal of at least some of the remaining longitudinal wires with respective gripping members.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
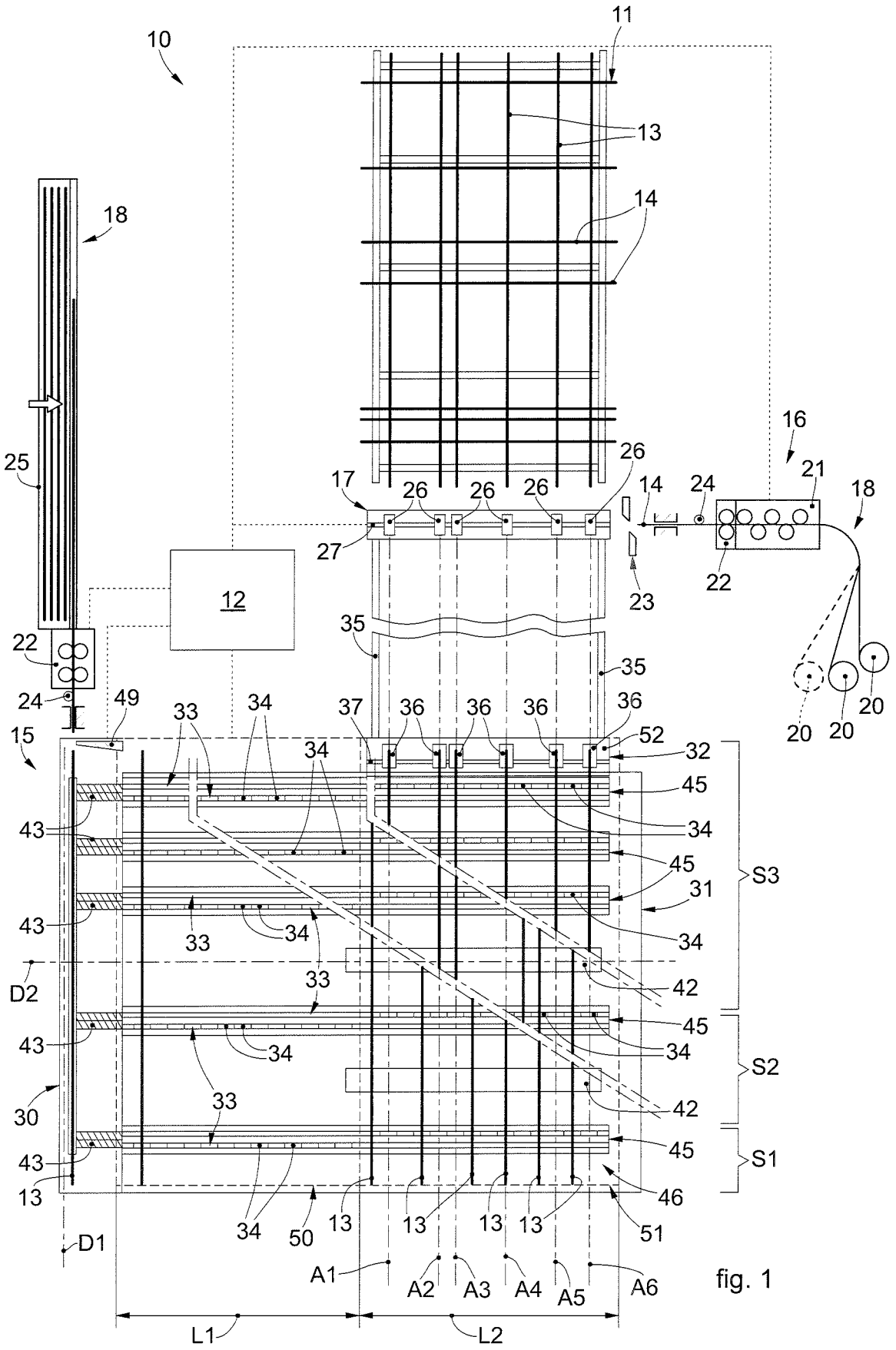
FIG. 1 is a schematic representation of an apparatus to make a wire mesh, in which possible positions of the longitudinal wires are shown.

Embodiments described here, with reference to the attached drawings, concern an apparatus 10 to make a wire mesh 11. In particular, with the present invention it is possible to make wire meshes 11 having the size of the links and disposition of the wires that make up the wire mesh 11 predefined on each occasion.

The wire meshes 11 are defined by longitudinal wires 13 and by transverse wires 14. The longitudinal wires 13 and the transverse wires 14 can have the same diameter or different diameter.

The pitch between longitudinal wires 13 and/or the pitch between transverse wires 14 can be, on each occasion, defined according to the operating requirements that the wire mesh 11 will have during use.

The wires, whether they are longitudinal 13 or transverse 14, can have a cross-section shape that is round, oval, square, rectangular or polygonal.

The longitudinal wires 13 and the transverse wires 14 can be smooth, ribbed or corrugated to obtain, during use, a better grip in the concrete. The longitudinal wires 13 and the transverse wires 14 can be rolled and/or drawn.

The transverse wires 14 are welded to the longitudinal wires 13, for example electro-welded in correspondence with the zones of reciprocal overlap.

According to one aspect of the present invention, the apparatus 10 comprises a first feeder 15 configured to feed one longitudinal wire 13 on each occasion, disposing it in a first direction D1. In particular, the longitudinal wire 13 is positioned with its oblong development parallel to the first direction D1.

According to a possible variant embodiment, not shown, the first feeder 15 is configured to feed, on each occasion, more than one longitudinal wire 13, for example to feed two, three or more longitudinal wires 13.

In particular, it can be provided that the first feeder 15 is configured to feed the longitudinal wire 13 moving it in a direction aligned with the first direction D1, or in a direction parallel to the first direction D1, for example by supplying it from above or laterally.

According to a possible solution (FIG. 1), the first feeder 15 can comprise a store 25 in which the longitudinal wires 13 already pre-cut to a predetermined length are positioned.

According to a possible variant embodiment, not shown, the first feeder 15 can comprise one or more wire unwinding reels and cutting and straightening means provided to define the length of the first longitudinal wires 13.

According to a possible solution, the first feeder 15 can comprise a drawing member 22 provided to feed the longitudinal wires 13 in a direction aligned to the first direction D1.

The store 25 can be provided with respective positioning devices, not shown, provided to position the longitudinal wires 13 in correspondence with the drawing members 22.

The first feeder 15 can also comprise measuring means 24, for example a counter roller, provided to detect the length of the longitudinal wire which is fed, on each occasion, by the drawing member 22.

Downstream of the first feeder 15 a positioning unit 31 is provided, configured to receive a plurality of the longitudinal wires 13 from the first feeder 15 and to position them parallel to each other and reciprocally distanced according to a predetermined pattern.

In accordance with a possible solution, the positioning unit 31 is located adjacent, with respect to the first direction D1, to the first feeder 15.

In accordance with possible solutions, the positioning unit 31 comprises at least one positioning device 45 configured to receive the longitudinal wires 13 and to move them keeping them parallel and distanced from each other in a direction of movement D2 orthogonal to the first direction D1.

According to an advantageous solution, the positioning unit 31 comprises a plurality of positioning devices 45 located parallel to each other, in a direction orthogonal to the first direction D1, and each configured to move the longitudinal wires 13 in a direction orthogonal to the first direction D1.

The at least one positioning device 45, in this case the positioning devices 45, define a support plane 46 on which to dispose the longitudinal wires 13, all lying on a common lying plane.

The at least one positioning device 45, in this case each positioning device 45, can comprise a plurality of housing seatings 34 associated with a support element 33 and reciprocally distanced from each other by a predetermined pitch.

In particular, it can be provided that the housing seatings 34 are provided on at least one portion of the support element 33 one adjacent to the other. Each housing seating 34 is configured to receive at least one of the longitudinal wires 13.

The support element 33 is configured to support the housing seatings 34 aligned with each other in a direction orthogonal to the first direction D1.

According to a possible solution, the positioning unit 31 can comprise a preparation zone 50 and a delivery zone 51 located adjacent in a direction parallel to the direction of movement D2. In other words, the preparation zone 50 and the delivery zone 51 are adjacent in the direction of movement D2.

The preparation zone 50 has a first width L1, measured in a direction parallel to the direction of movement D2, at least equal to or greater than a second width L2, also measured in a direction parallel to the direction of movement D2, at least equal to or greater than the width L2 of the delivery zone 51.

In this way, while in the delivery zone 51 there is a first group of longitudinal wires 13 ready, or possibly transferring to the welding unit 17, the preparation zone 50 can be used to load and position correctly on the positioning unit 31 a new group of longitudinal wires 13 already reciprocally distanced from each other.

This solution allows to drastically reduce the downtimes of feeding the longitudinal wires to the welding unit, considerably increasing productivity and plant efficiency.

The first width L1 and the second width L2 can be at least equal to, or greater than, the width of the wire mesh 11 to be obtained, or at least equal to the reciprocal distance between the two longitudinal wires located on the external perimeter of the wire mesh 11.

In the preparation zone 50 the first feeder 15 supplies, on each occasion, one of the longitudinal wires 13 until a positioning pattern is defined for the longitudinal wires 13 defining a wire mesh 11. Once the loading of the group of longitudinal wires 13 defining a wire mesh 11 has been completed in the preparation zone 50, the same are moved and taken into correspondence with the delivery zone 51 so that they can be removed.

The support element 33 is configured to take the housing seatings 34 from the preparation zone 50 to the delivery zone 51.

According to possible solutions, the support element 33 can comprise at least one of either a chain, a belt, a conveyor belt, a cable.

In accordance with a possible solution, shown in FIGS. 2-5 for example, the support element 33 integrates the housing seatings 34.

By way of example only (FIGS. 2-5), it can be provided that the support element 33 comprises a chain and the links of the latter, due to how they are conformed, define the housing seatings 34.

In accordance with possible variant embodiments, not shown, the housing seatings 34 can be made in shaped bodies, which are attached to the support element 33 according to a predetermined pitch.

The support element 33 can develop in a closed ring and wind around return rollers 47.

In this way, the support element 33 defines a first return segment 33*a*, facing upward during use, and configured to define, on each occasion, the support plane 46, and a second return segment 33*b* opposite the first return segment 33*a*, and facing downward during use.

In accordance with this embodiment, it can be provided that a part of the first return segment 33*a* is positioned in the preparation zone 50 while a second part of the first return segment 33*a*, consecutive to the first return segment 33*a*, is positioned in the delivery zone 51.

By way of example only, it can be provided that the housing seatings 34 are reciprocally distanced from each other by a pitch comprised between 15 mm and 100 mm, preferably between 30 mm and 70 mm.

According to possible solutions, an actuation device 48 can be associated with the support element 33 and is configured to move the support element 33 and the housing seatings 34 in a direction of movement D2 orthogonal to the first direction D1.

The actuation device 48 can be associated with at least one of the two return rollers 47.

The housing seatings 34 in this way can be taken into the preparation zone 50 where each longitudinal wire 13 supplied by the first feeder 15 is positioned in the housing seatings 34. The housing seatings 34 are then translated toward the delivery zone 51 to allow the longitudinal wires 13 to be removed as described below.

By suitably coordinating the discharge action of the longitudinal wire 13 in the housing seatings 34, with the movement of the positioning devices 45 it is possible to obtain a control of the positioning of the longitudinal wires 13 in the housing seatings 34, and therefore to obtain a precise control of the reciprocal position of the longitudinal wires 13 themselves.

In particular, by suitably coordinating the positioning, or the discharge, of the longitudinal wires 13 in the housing seatings 34, it is possible to dispose the longitudinal wires according to an already predefined pattern close to that of the subsequent remove, as described below.

According to a possible solution, if there are several positioning devices 45, it can be provided that each of them is provided with at least two support elements 33 located parallel to each other and each of which is provided with respective housing seatings 34.

In particular, it can be provided that a first of the two support elements 33 can be positioned in the preparation zone 50 to receive the longitudinal wires 13 from the first feeder 15 and can be moved toward the delivery zone 51 to allow the subsequent removal of the longitudinal wires 13. While a second of the two support elements 33 can be positioned in the delivery zone 51 to allow the subsequent removal and delivery of other longitudinal wires, and is movable toward the preparation zone 50 and vice versa. The first and second support elements 33 can be moved alternately between the preparation zone 50 and the delivery zone 51 and vice versa, alternately exchanging their position, that is, when one is located in the preparation zone 50 the other is located in the delivery zone 51, and vice versa.

This solution allows to drastically reduce the downtimes between the positioning steps of the longitudinal wires 13 in the positioning unit 31 and the subsequent removal steps.

The support element 33 can be provided with the housing seatings 34 for only a portion of its overall length, or for a longitudinal extension substantially mating with the length of the delivery zone 51.

In accordance with a possible solution, the first feeder 15 can comprise a supply unit 30 able to provide, in sequence, a single longitudinal wire 13 to the positioning unit 31.

In particular, once it has received a longitudinal wire 13, for example from the drawing member 22, the supply unit 30 delivers it to the specific housing seating 34 of the positioning device 45.

The supply unit 30 can be configured to supply the single longitudinal wire 13 by translating it in a direction parallel to the direction of movement D2.

According to possible solutions, the supply unit 30 can comprise a plurality of screws 43 distanced from each other in a direction parallel to the first direction D1. The screws 43 each allow to support the respective longitudinal wire 13 in correspondence with different zones of the longitudinal extension of the latter.

In particular, the first feeder 15 feeds one of the longitudinal wires 13 in correspondence with respective cavities each of which is defined between a respective spiral of the respective screw 43.

By making the screws 43 rotate in a synchronized manner, it is possible to make the longitudinal wire 13 advance in a direction parallel to the axes of the screws 43 and to discharge it into one of the housing seatings 34 of the positioning device 45.

To this purpose, the screws 43 can be disposed with their axes of rotation substantially orthogonal to the first direction D1 and parallel to the direction of movement D2.

The use of the screws 43, moreover, allows to butt the longitudinal wires 13, for example in correspondence with an abutment body 49, possibly present at the side of the supply unit 30 and the positioning unit 31.

According to one aspect of the present invention, the apparatus comprises a removal and supply unit 32 configured to remove the longitudinal wires 13 from the positioning unit 31 and supply them to a welding unit 17.

The removal and supply unit 32 comprises a plurality of gripping members 36 disposed adjacent to each other along a positioning axis substantially parallel to the movement axis D2.

The gripping members 36 are configured to remove individual longitudinal wires 13 from the housing seatings 34 and to move them each in respective directions of feed, in the case shown in FIGS. 1-5 the directions of feed A1, A2, A3, A4, A5 and A6. The directions of feed A1-A6 are located reciprocally distanced from each other according to a pattern coordinated with that which the longitudinal wires 13 will assume once they have been welded to the transverse wires 14.

The reciprocal distances between the directions of feed A1-A6 can therefore correspond with the reciprocal distances between the gripping members 36.

With the solution of the present invention, it is possible to provide that the reciprocal distances between the longitudinal wires 13 do not necessarily correspond to a pitch or a multiple of the pitch between the housing seatings 34. The reciprocal distances are completely independent from the housing seatings 34 and are determined on each occasion according to the structural resistance parameters required of the mesh.

The gripping members 36 can be located in correspondence with one side of the support plane 46 of the positioning unit 31 which is located parallel to the direction of movement D2. In this way, each of the gripping members 36 can take and feed one of the terminal ends of the longitudinal wires 13.

The gripping members 36 can be positioned, at least in the condition where they remove the longitudinal wires 13, above or below the support plane 46 so as to be able to take the longitudinal wires 13 with the simple activation of the gripping members 36.

The removal and supply unit 32 can comprise a positioning guide 37, located parallel to the direction of movement D2 and on which the gripping members 36 are positioned.

The removal and supply unit 32 can comprise positioning means, not shown, provided to position each gripping member in a predefined position along the positioning guide 37 and corresponding to the reciprocal distance between the movement distances A1-A6. The positioning means can be driven in the initial setting step of the apparatus according to the construction parameters required for the construction of the mesh.

Each gripping member 36 can comprise at least one removal gripper 38 configured to take a longitudinal wire 13 from a respective housing seating 34.

In accordance with a possible solution, the removal gripper 38 can have a gripping amplitude that is greater than or equal to the pitch between contiguous housing seatings 34.

In this way the removal gripper 38 with a gripping action can remove a longitudinal wire 13 even if not perfectly aligned with the corresponding direction of feed A1-A6.

Closing the removal gripper 38 causes the alignment of the end of the longitudinal wire 13 to the corresponding direction of feed A1-A6.

In other embodiments, the gripping member 36 can comprise, or also comprise, a holding gripper 39 able to retain the longitudinal wire 13 removed, to also allow it to be subsequently drawn in the corresponding direction of feed A1-A6.

According to possible embodiments, the gripping members 36 can each comprise an actuation device 53 configured to move the gripping members 36 between a gripping position, in which they remove the corresponding longitudinal wires 13 from the housing seatings 34, and a holding and supply position in which the gripping members 36 retain and supply the longitudinal wires 13 in the corresponding welding heads 26.

In particular, it can be provided that the actuation devices 53 are mobile in a direction orthogonal to the support plane 46, or to take the gripping members into a gripping condition or of non-interference with the movement of the longitudinal wires 13.

Each gripping member 36 can comprise a detection device 40 able to detect the presence of the longitudinal wire 13 when it is located in the removal gripper 38 and/or in the holding gripper 39.

According to possible embodiments, the detection device 40 is configured to detect the presence of the longitudinal wire 13 by contact, for example it can be provided with a mobile portion 41 located in the alignment direction A1-A6 where the longitudinal wire 13 will be positioned. When the longitudinal wire 13 comes into contact with the mobile portion 41, the latter rises up without obstructing the longitudinal wire 13 and provides a signal confirming the grip of the longitudinal wire 13. The confirmation signal can comprise a signal of consent to the start of subsequent operating steps, a luminous signal, an acoustic signal.

The gripping members 36 can be installed on a common support structure 52 mobile between the positioning unit 31 and the welding unit 17 in a direction parallel to the directions of feed A1-A6.

The movement of the support structure 52 allows to simultaneously translate all the longitudinal wires 13 in the directions of feed A1-A6.

In accordance with possible solutions, the support structure 52 can be installed on guides 35 located parallel to the directions of feed A1-A6. The guides 35 can have a longitudinal extension greater than or equal to the length of the longitudinal wires 13. In this way, when the support structure 52 is moved, the longitudinal wires 13 are extracted completely from the support plane 46, leaving the latter free.

In accordance with possible solutions, the positioning unit 31 can comprise lifting members 42 able to lift the longitudinal wires 13 above the support plane 46, and remove them from the housing seatings 34. In this way, when the longitudinal wires 13 are moved in the directions of feed A1-A6, they do not slide in the housing seatings 34, causing possible wear.

The lifting members 42 can be positioned between at least one pair of positioning devices 45 and can be mobile vertically with respect to the support plane 46.

The lifting members 42 can each comprise a support plane, with a substantially flat shape and provided to completely lift the longitudinal wires 13 from the positioning devices 45.

The lifting members 42 can be disposed in the delivery zone 41. When the longitudinal wires 13 are lifted by the lifting members 42, the positioning devices 45 can be moved again to position themselves in the preparation zone 50, or in proximity to it. This further increases the efficiency of the apparatus and reduces downtimes.

The apparatus 10 in accordance with the present invention also comprises a welding unit 17 configured to weld the longitudinal wires 13 with at least one transverse wire 14.

In particular, it can be provided that the welding unit 17 comprises a plurality of welding heads 26 each of which is configured to weld a respective longitudinal wire 13 with the at least one transverse wire 14.

The welding heads 26 can be installed aligned with each other along a common positioning axis which is orthogonal to the directions of feed A1-A6.

In particular, it can be provided that each welding head 26 is aligned with a respective axis of feed A1-A6.

In this way, once the longitudinal wires 13 have been removed from the positioning unit 31, the removal and supply unit 32 transfers them in correspondence with the welding heads 26 for translation along the axes of feed A1-A6.

Each welding head 26 can be positioned in correspondence with one of the reciprocal overlap zones of the respective wires. For example, the welding heads 26 can be positioned, for example during the initial setting steps, by suitable actuators along a positioning guide 27.

In accordance with possible embodiments, each welding head 26 can comprise a first electrode 28 and a second electrode 29 opposite each other with respect to the reciprocal overlap zones of the longitudinal wire 13 and the transverse wire 14.

The first and second electrodes 28 and 29 can be electrically powered by an electric energy generator, not shown, to apply the energy necessary for welding to the longitudinal wires 13 and the transverse wires 14.

At least one of either the first electrode 28 or the second electrode 29 can be selectively movable between a first position, in which the two electrodes 28 and 29 are distanced from each other, defining a gap, where the wires to be welded can be located, and a second welding position, in which the two electrodes 28 and 29 clamp and weld the wires.

The welding heads 26 can each be provided with feed means, not shown, and configured to make the longitudinal wires 13, received from the removal and supply unit 32, advance through the welding unit 17 itself.

Depending on the advance pitch of the longitudinal wires 13 and the frequency with which the transverse wires 14 are supplied, the interaxis between the transverse wires 14 is defined on each occasion.

The apparatus 10 also comprises a second feeder 16 provided to feed, on each occasion, at least one transverse wire 14 located transversely to the axes of feed A1-A6. The second feeder 16 can be substantially analogous to the first feeder 15 described above.

According to a possible solution (FIG. 1), the second feeder 16 can comprise one or more reels 20 to supply a longitudinal wire 13, a possible straightening member 21, a drawing member 22 and a cutting member 23 configured to cut the metal wire to a predefined length and to define the transverse wires 14. The second feeder 16 can also comprise measuring means 24 substantially analogous to what was described above for the first feeder 15.

With reference to FIGS. 2-5, a sequence of the positioning and removal steps of the longitudinal wires 13 is shown.

In particular, the gripping members 36 are located at a distance from each other according to predetermined distances and established by specifications, which substantially correspond with the reciprocal distances that the longitudinal wires 13 will assume when welded to the transverse wires 14.

The first feeder 15 delivers a longitudinal wire 13 on each occasion to the positioning unit 31, disposing it in a corresponding housing seating 34. The delivery of the longitudinal wires 13 is such that once all of these are positioned in correspondence with the delivery zone 51, they assume a position, that is, a reciprocal positioning of the wires, which is close to that of the directions of feed.

FIGS. 2-6 show the feed of four longitudinal wires 13 by means of four gripping members 36 disposed in respective directions of feed A1-A4.

Figure 2:
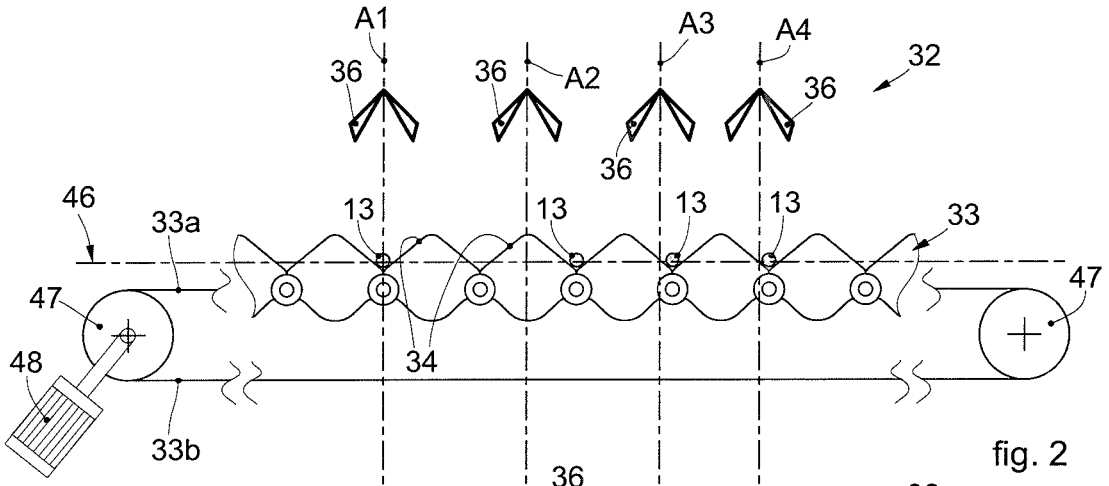
FIGS. 2-5 schematically show a positioning unit and a removal and supply unit in subsequent steps of positioning and removal of longitudinal wires.
Figure 3:
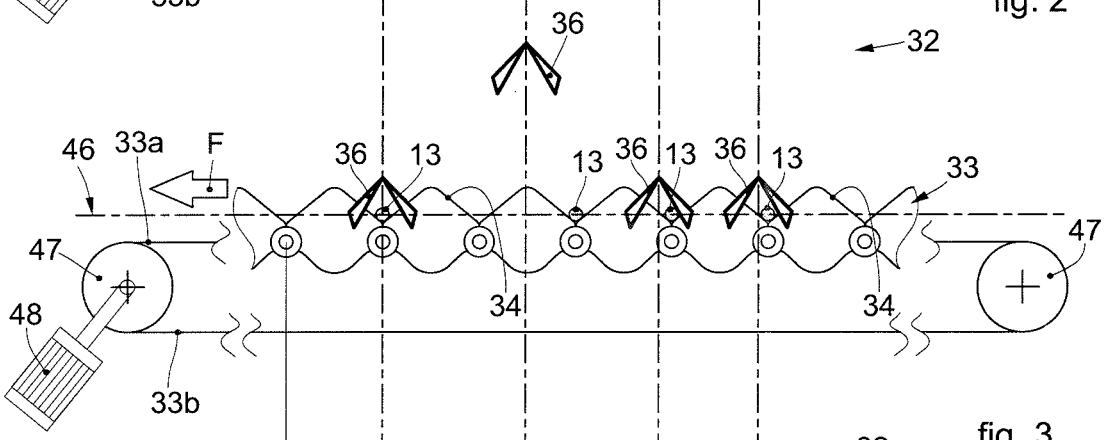

With reference to FIG. 2, the longitudinal wires 13 located in correspondence with the directions of feed A1, A3 and A4 can be removed from the respective gripping members 36.

Figure 4:
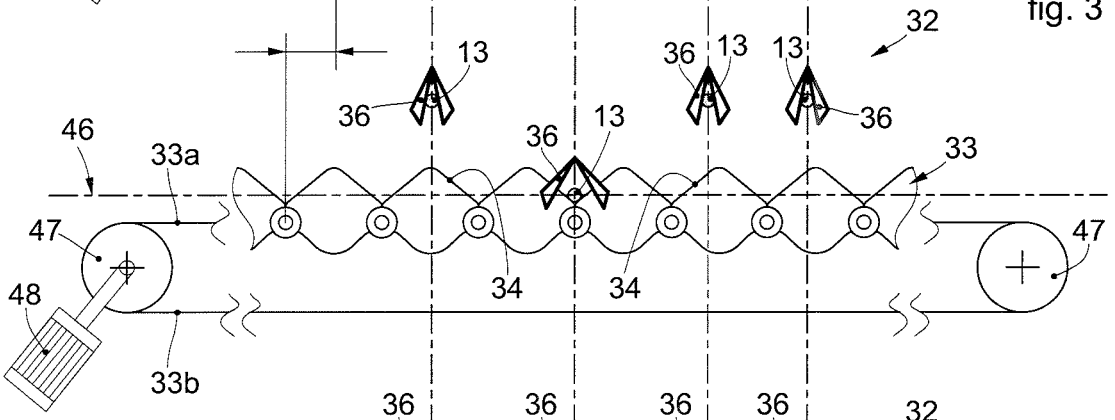
Figure 5:
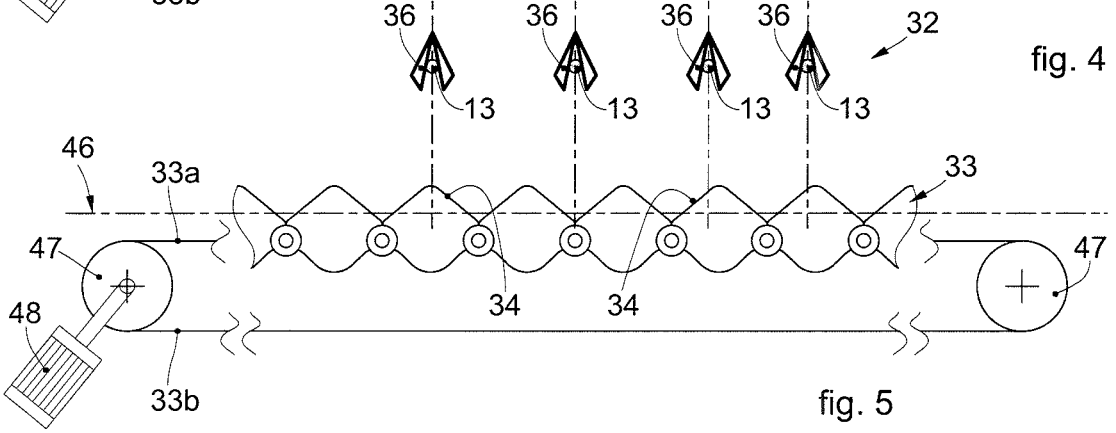
Figure 6:
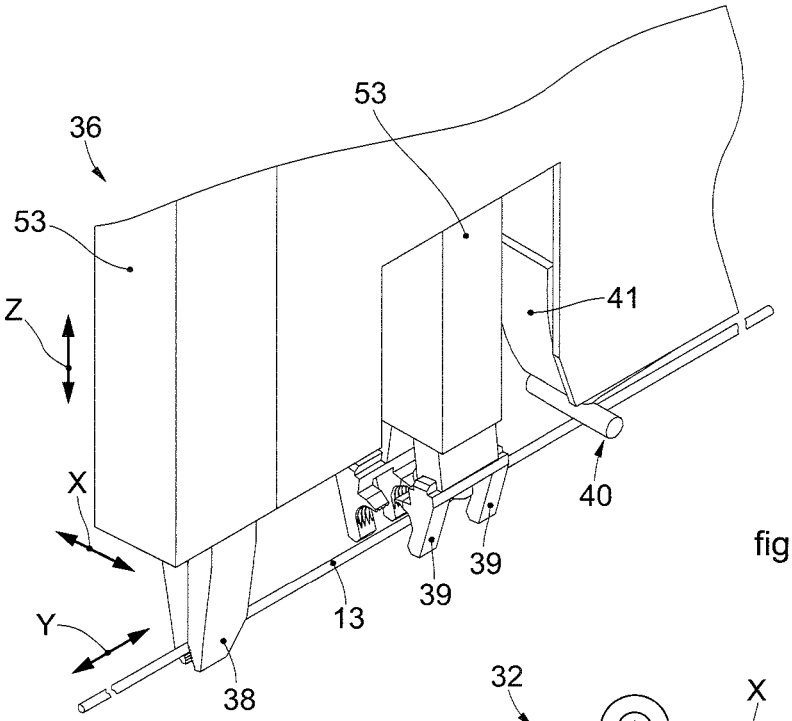
FIG. 6 is a perspective view of a possible embodiment of a gripping member of a removal and supply unit.

Subsequently, in order to remove the longitudinal wire 13 that has not been removed, a movement of the positioning device 45 is provided, according to the direction indicated by the arrow F (FIG. 3), to dispose the longitudinal wire 13 in a position suitable for removal by the free gripping member 36 (FIGS. 4 and 5).

With reference to FIG. 1, three possible positioning configurations S1, S2, S3 of the longitudinal wires 13 are shown.

In the first configuration S1, the first feeder 15 delivers the longitudinal wires 13 to the positioning unit 31, disposing them reciprocally distanced from each other so that when located in the delivery zone 51 each is aligned to one of the directions of feed A1-A6.

In the second configuration S2, when the longitudinal wires 13 are taken to the delivery zone 51, only some of them are aligned to the respective directions of feed A1-A6, in this case to the directions of feed A2 and A3. The longitudinal wires 13 located in these positions can be removed directly by the respective gripping members 36. Subsequently, a translation is provided, with the positioning devices 45, of the remaining longitudinal wires 13 not removed, in order to dispose them in correspondence with the other gripping members 36 and carry out the subsequent removal of the longitudinal wires 13.

In the third configuration S3, only the longitudinal wire 13 located in correspondence with the direction of feed A4 can be removed by the respective gripping member 36. Subsequently, with the positioning devices 45, it is possible to translate the longitudinal wires 13 laterally to dispose them in correspondence with the respective gripping members 36 provided for their removal.

In accordance with this solution, even if the first feeder 15 does not deliver the longitudinal wires 13 to the positioning unit 31 in positions close to those of the subsequent removal by the removal and supply unit 32, by suitably coordinating the actuation of the positioning devices 45, it is possible to dispose the longitudinal wires 13 in the positions suitable for removal by the removal and supply unit 32.

According to possible embodiments, the apparatus 10 comprises a control and command unit 12 configured to manage and coordinate the functioning of the units of the apparatus 10 to make wire meshes 11 which have the desired links on each occasion.

In particular, the control and command unit 12 can be connected at least to the first feeder 15, to the positioning unit 31 and to the removal and supply unit 32 in order to coordinate their drive and allow the correct removal of the longitudinal wires 13 by the removal and supply unit 32.

Embodiments of the present invention also concern a machine to supply longitudinal wires 13 which comprises the first feeder 15, the positioning unit 31 and the removal and supply unit 32 as described above.

It is clear that modifications and/or additions of parts and/or steps can be made to the apparatus 10 and to the method to make wire meshes 11 as described heretofore, without departing from the field and scope of the present invention.

Figure 7:
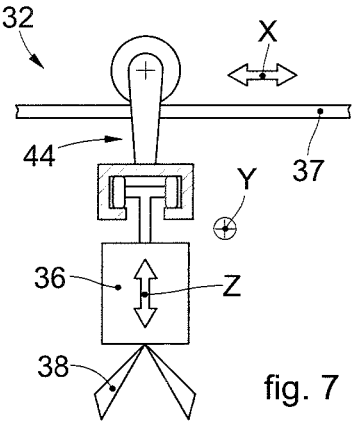
FIG. 7 is a schematic view that shows a gripping unit of the removal and supply unit.
Figure 8:
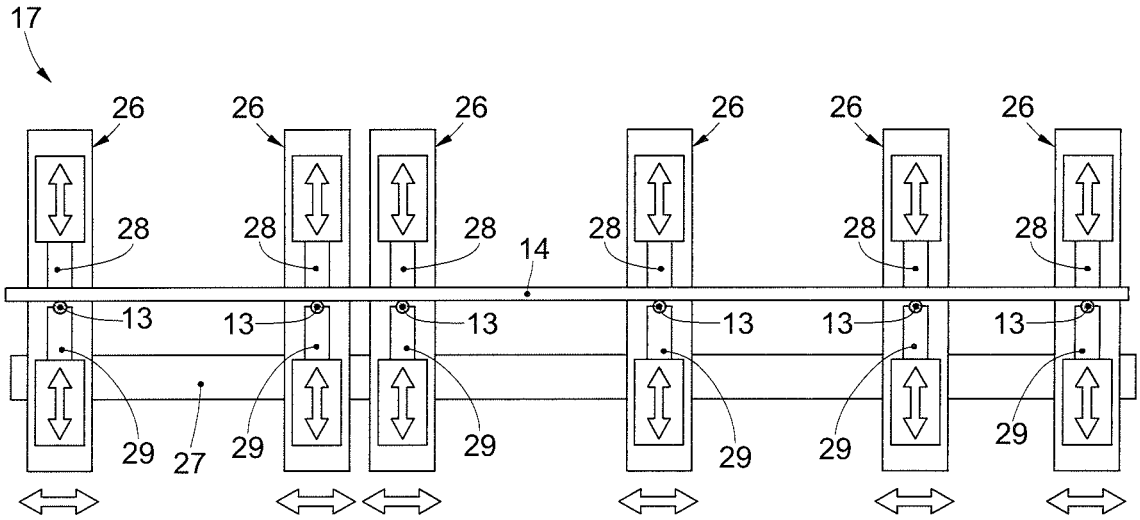
FIG. 8 is a schematic view of a welding unit according to a possible embodiment of the present invention.

According to a possible variant embodiment (FIG. 7), each gripping member 36 of the removal and supply unit 32 can be moved along three orthogonal axes X, Y, and Z (shown in FIG. 7) by means of suitable movement members 44. The movement members 44 can comprise actuators, motor members, guides, mobile sliders, or other devices able to move in a direction defined by at least one orthogonal axis X, Y, Z. The axis X can be perpendicular to the directions of feed A1-A6. The axis Y can be parallel to the corresponding directions of feed A1-A6. The axis Z is orthogonal to the axis X and to the axis Y.

It is also clear that, although the present invention has been described with reference to some specific examples, a person of skill in the art shall certainly be able to achieve many other equivalent forms of the apparatus 10 and the method, having the characteristics as set forth in the claims and hence all coming within the field of protection defined thereby.

The invention claimed is:

1. An apparatus to make a wire mesh (11) comprising:

a welding unit (17), a first feeder (15) configured to feed longitudinal wires (13), a second feeder (16) configured to feed at least one transverse wire (14) into said welding unit (17), a positioning unit (31) configured to receive from said first feeder (15) a plurality of said longitudinal wires (13), disposed parallel to a first direction (D1) and distanced according to a pre-set pattern on a support plane (46) defined by at least one positioning device (45), wherein said at least one positioning device (45) is configured to move said longitudinal wires (13) keeping them parallel and distanced from each other in a direction of movement (D2) orthogonal to said first direction (D1), said positioning device (45) comprising a plurality of housing seatings (34) configured to receive at least one of said longitudinal wires (13), wherein said positioning unit (31) further comprises lifting members (42) able to lift the longitudinal wires (13) above the support plane (46), and remove the longitudinal wires (13) from the housing seatings (34), a plurality of gripping members (36) each configured to remove one of said longitudinal wires (13) from said positioning unit (31) and to transfer them in respective directions of feed (A1, A2, A3, A4, A5, A6) and toward said welding unit (17), said directions of feed (A1, A2, A3, A4, A5, A6) being mutually distanced from one another, wherein said positioning unit (31) comprises a preparation zone (50) and a delivery zone (51) adjacent to each other in a direction parallel to said direction of movement (D2), said gripping members (36) being located in said delivery zone (51), and said preparation zone (50) having a width (L1), in a direction parallel to the direction of movement (D2), at least equal to or greater than the width (L2) of said delivery zone (51), wherein each of said lifting members (42) comprises a support plane, with a substantially flat shape.

2. The apparatus of claim 1, wherein said positioning unit (31) further comprises at least a second positioning device (45) parallel to the first positioning device (45) in a direction orthogonal to the first direction (D1), in which said housing seatings (34) are associated with at least one support element (33) and are distanced mutually from each other by a pre-set pitch, said support element (33) being configured to take said housing seatings (34) from said preparation zone (50) to said delivery zone (51), and to said delivery zone (51) to said preparation zone (50).

3. The apparatus of claim 2, wherein said positioning devices (45) are each provided with at least two support elements (33) located parallel to each other and each of which is provided with respective housing seatings (34), and a first of the two support elements (33) can be positioned in the preparation zone (50) in order to receive the longitudinal wires (13) from the first feeder (15) and can be moved toward the delivery zone (51), and a second of the two support elements (33) can be positioned in the delivery zone (51) to allow the removal and delivery of other longitudinal wires, and can be moved toward the preparation zone (50).

4. The apparatus of claim 2, wherein said support element (33) defines a first return segment (33*a*), facing upward during use, and configured to define a support plane (46), and a second return segment (33*b*) opposite the first return segment (33*a*), and facing downward during use, and wherein a part of the first return segment (33*a*) is positioned in the preparation zone (50) and a second part of the first return segment (33*a*), consecutive to the first return segment (33*a*), is positioned in the delivery zone (51).

5. The apparatus of claim 1, wherein an actuation device (48) is associated with said support element (33) and is configured to move said support element (33) and said housing seatings (34) in said direction of movement (D2).

6. The apparatus of claim 1, wherein each of said gripping members (36) is aligned with a respective direction of feed (A1, A2, A3, A4, A5, A6) and comprises at least one removal gripper (38) configured to take a longitudinal wire (13) from a respective housing seating (34), said removal gripper (38) having a gripping amplitude that is greater than or equal to the pitch between contiguous housing seatings (34).

7. The apparatus of claim 1, wherein said welding unit (17) comprises a plurality of welding heads (26) configured to weld said longitudinal wires (13) and said transverse wires (14) to each other, and each of said welding heads (26) is aligned with a respective direction of feed (A1, A2, A3, A4, A5, A6).

8. The apparatus of claim 1, wherein said first feeder (15) is configured to dispose said longitudinal wires (13) in said first direction (D1) and comprises a store (25) for the longitudinal wires (13) and/or one or more wire unwinding reels combined with cutting and straightening means, drawing members (22) and measuring means (24).

9. The apparatus of claim 1, wherein said at least one positioning device (45) defines a support plane (46) on which to dispose said longitudinal wires (13).

10. The apparatus of claim 9, wherein said gripping members (36) are disposed in correspondence with one side of said support plane (46), said side being parallel to said direction of movement (D2).

11. The apparatus of claim 1, wherein said gripping members (36) are installed on a common support structure (52) mobile between said positioning unit (31) and said welding unit (17) in a direction parallel to said directions of feed (A1, A2, A3, A4, A5, A6).

12. A method to make a wire mesh (11) that provides to:

feed with a first feeder (15) longitudinal wires (13) of said wire mesh (11), feed with a second feeder (16) at least one transverse wire (14) to said welding unit (17), receive from said first feeder (15) a plurality of said longitudinal wires (13) which are disposed in a positioning unit (31) parallel to a first direction (D1) and distanced according to a pre-set pattern on a support plane (46), move the longitudinal wires (13) with a positioning device (45), keeping them in a plurality of housing seatings (34) parallel and distanced from each other in a direction of movement (D2) orthogonal to the first direction (D1), remove each of said longitudinal wires (13) from the positioning unit (31) with a respective gripping member (36), and transfer said longitudinal wires (13) with said gripping members (36) in respective directions of feed (A1, A2, A3, A4, A5, A6) and toward said welding unit (17), said directions of feed (A1, A2, A3, A4, A5, A6) being mutually distanced from each other according to a second pre-set pattern coordinated to that which said longitudinal wires (13) will assume when welded to said transverse wires (14), wherein said positioning unit (31) comprises a preparation zone (50) and a delivery zone (51) adjacent to each other in a direction parallel to said direction of movement (D2), and while in said preparation zone (50) said first feeder (15) delivers a first group of longitudinal wires (13) distancing them from each other according to the pre-set pattern, in said delivery zone (51) lifting members (42), each comprising a support plane with a substantially flat shape, lift a second group of longitudinal wires (13), previously prepared in said preparation zone (50), above the support plane (46), removing the second group of longitudinal wires (13) from the housing seatings (34) and making the second group of longitudinal wires (13) to be taken by said gripping members (36).

13. The method of claim 12, further providing to:

position a plurality of welding heads (26) of said welding unit (17) each aligned with a respective direction of feed (A1, A2, A3, A4, A5, A6) and based on an interaxis between said longitudinal wires (13) of said wire mesh (11) to be made.

14. The method of claim 12, further providing to:

position each of said gripping members (36) aligned with a respective direction of feed (A1, A2, A3, A4, A5, A6) and to take a longitudinal wire (13) from a respective housing seating (34) with a removal gripper (38) the closing of which causes the alignment of the end of said longitudinal wire (13) to the corresponding direction of feed (A1-A6).

15. The method of claim 12, further providing to:

supply, to said positioning unit (31) and with said first feeder (15), said longitudinal wires (13), which being mutually distanced according to a third pattern similar to that of a second removal, to perform a first removal of some of said longitudinal wires (13) with respective gripping members (36), to translate in said direction of movement (D2) remaining longitudinal wires (13) on the positioning unit (31) so as to perform at least the second removal of at least some of said remaining longitudinal wires (13) with respective gripping members (36).

* * * * *